United States Patent [19]

Wulz

[11] 4,290,176

[45] Sep. 22, 1981

[54] SLIDE FASTENER AND METHOD OF MAKING SAME

[75] Inventor: Helmut Wulz, Birmensdorf, Switzerland

[73] Assignee: Optilon W. Erich Heilmann GmbH, Cham, Switzerland

[21] Appl. No.: 125,783

[22] Filed: Feb. 29, 1980

[30] Foreign Application Priority Data

Mar. 1, 1979 [DE] Fed. Rep. of Germany ..... 2907954

[51] Int. Cl.[3] ..... A44B 19/40

[52] U.S. Cl. ..... 24/205.16 R; 24/205.13 R

[58] Field of Search ..... 24/205, 205.16 R, 205.16 C, 24/205.13 R, 205.13 D, 205.13 C

[56] References Cited

U.S. PATENT DOCUMENTS

| | | | |
|---|---|---|---|
| 3,436,041 | 4/1969 | Haller | 24/205.13 C |
| 3,482,290 | 12/1969 | Uhrig | 24/205.13 C X |
| 3,883,381 | 5/1975 | Thaeler | 24/205.16 R |
| 3,900,929 | 8/1975 | Takamatsu | 24/205.16 R |
| 3,977,053 | 8/1976 | Takamatsu | 24/205.16 R |
| 3,984,901 | 10/1976 | Takamatsu | 24/205.16 C |
| 4,186,467 | 2/1980 | Lawrence 24 | 205.16 R/ |
| 4,210,985 | 7/1980 | Scott | 24/205.16 R |

*Primary Examiner*—Roy D. Frazier
*Assistant Examiner*—Peter A. Aschenbrenner
*Attorney, Agent, or Firm*—Karl F. Ross

[57] ABSTRACT

A method of and an apparatus for the formation of slide-fastener stringers wherein coupling members of a thermoplastic synthetic resin are bent into a U configuration to straddle the edges of respective fabric support tapes also composed of thermoplastic synthetic-resin filaments or yarns at least in the region in which the tape is straddled by the shanks of each coupling member. The shanks of the coupling members are thermally welded together through the tape and thereby also bonded to the filaments or yarn between the shanks; thereafter the tapes bearing the coupling members are subjected to thermofixing i.e. heating to shrink the tapes thereby condensing the meshes formed by the yarn or filaments.

10 Claims, 9 Drawing Figures

SLIDE FASTENER AND METHOD OF MAKING SAME

CROSS REFERENCE TO RELATED APPLICATIONS

The present application is related to my copending application Ser. No. 056,394 filed July 10, 1979 and entitled SLIDE FASTENER AND METHOD OF MAKING SAME. Reference may also be had to the prior work mentioned in this application and the patents or publications in the file thereof.

FIELD OF THE INVENTION

My present invention relates to a slide fastener and to a method of making same. More particularly, this invention relates to a slide-fastener stringer of the type in which a pair of support tapes formed from filaments or yarns and of knitted, woven or hybrid configuration carry along confronting edges spaced apart coupling members in respective rows so that movement of a slider along these rows can cause the coupling members to interdigitate or separate depending upon the direction of slider movement.

BACKGROUND OF THE INVENTION

A slide-fastener stringer, as this term is used herein, will be considered to consist of a pair of support tapes each of which can carry along a longitudinal edge confronting the other support tape, a row of spaced apart coupling members capable of interdigitating with the other row.

In its use such a stringer, consisting of two slide-fastener halves, can be provided with end-stop members at opposite ends of each or both rows to prevent withdrawal of a slider which rides along the rows. In a so-called "separable" slide fastener, these end-stop members can be connectable at one end of the stringer and can be disconnected to allow the slider to remain on only one of the slide-fastener halves in an open condition of the slide fastener.

The term coupling member is used herein to refer to a projection from the longitudinal edge of the other support tape and engage behind projections of the latter. The portions of the projections which thus interdigitate or engage are usually shaped so as to resist separation by forces applied transverse to the slide fastener axis or the rows of coupling members. These portions of the projections, referred to herein as coupling heads, can be affixed to the respective support tapes by shanks which extend inwardly beyond the edge and can straddle the opposite faces of the tape. Thus the coupling members can have a generally U-shaped configuration with the head formed at the bight of the U and the shanks constituting the legs thereof.

The support tapes can be woven or knitted and can even be a hybrid, i.e. partly woven and partly knitted, in each case with or without inlaid yarns, strands or filaments. When any of these latter terms are used herein, any other of them will be deemed equivalent. For example, the tapes can be knitted and/or woven from synthetic-resin monofilament, i.e. single strand threads, or can be formed from multistrand threads, generally designated as yarns.

Whatever the particular thread construction, the tape will have a mesh structure, either formed by the knit loops or by the crossing weft and warp of the weave.

The mesh size is thus a function of the proximity of the yarns forming the mesh to one another.

Reference will also be made herein to the thermosetting of a tape. Thermosetting as this term is used herein will refer to the thermostabilization of the fabric structure which results from a combination of shrinking and stress-relieving in thermoplastic materials such as the filaments, threads or yarns, with or without the formation of fusion bonds at points at which threads cross over one another. Condensation of the mesh refers to a reduction in the openings left in a fabric by virtue of a closer disposition of the strands forming the mesh.

In this description reference may also be made to a filler cord. A filler cord is usually a single strand or a woven or braided bundle of strands of synthetic-resin filaments or natural fiber, usually of a thickness greater than that of the strands making up the fabric tape and usually knitted or woven into the tape along the longitudinal edge at which the coupling members are mounted so that the shanks of the coupling member can straddle these cords as well.

Two or more such strands may also be provided, e.g. in a side-by-side relationship to form a cord or "bead."

Furthermore, these cords can be compressible so that the coupling head of one row, upon interdigitation with the coupling heads of the second row, also bear against the filler cord of this latter row.

Finally, with respect to the general nature of slide-fastener stringers, mention may be made of the fact that the slider can be of conventional design and hence will not be described or discussed in detail. However, it may be noted that the slide-fastener stringer can be formed substantially continuously and cut into lengths whereupon the slider and end-stop members can be applied to the end-stop members molded from the thermoplastic material of the coupling members or tape by the application of heat or pressure.

The particular type of slide fastener, with which the present invention is concerned, has a stringer which utilizes U-shaped coupling members of thermoplastic synthetic resins and support tapes of synthetic yarn or filaments whereby each coupling member is formed in the region of the bight with a coupling head and between the shanks of the U with a coupling eye, the shanks straddling the edge of the support tape and being fixed thereto.

Coupling members of this type are generally bent into the U configuration from generally flat members or "blanks" and the filler cord can be disposed in the coupling eye so that in the interdigitated state or upon deformation of the fastener in the fastener plane or out of the latter compression is applied to the filler cord.

In German patent document (printed application—Auslegeschrift) DE-AS No. 16 10 325, the blanks adapted to form the coupling members, while in a flat state, constitute the rungs of a ladder which included textile strands which interconnect these members even when they are bent into the U-configuration to straddle the tape. The coupling members are fixed in place by a sewing seam. This method of fabricating slide-fastener stringers has been found to be an expensive operation in part because of the time-consuming and laborious sewing step. However, of possible greater significance is the fact that the sewing operation has been found not to secure the coupling members to the tape with sufficient firmness. When transverse or bending stresses are applied to such stringers, the stability in the closed state is lost. In practice, therefore, such systems have scarcely been used.

A more common system is that described in German patent document (open application—Offenlegungsschrift) DE-OS No. 27 22 054 in which a textile cord is provided as an independent element upon which the U-shaped bent coupling members are applied. In this case, four textile strands are customarily embedded in the shanks so that two such strands traverse each shank of each coupling member on a single support tape.

The row of coupling members thus forms an independent assembly which can be connected with the support tape during the weaving or knitting process so that, for example, only weft yarns during weaving and corresponding yarns during knitting engage the filler cord and the strands mentioned above.

In the region of the attachment of the coupling members, there are no warp threads or yarns of the tape.

This construction, while highly desirable because of the reliability of the spacing of the coupling heads, has not been completely satisfactory because the fabrication technique is expensive by reason of the need to feed the entire coupling member assembly to the knitting machine or the loom.

Experience has shown that weaving or knitting machines which must be fed with foreign assemblies of complex shape and construction can only operate at low speeds. In addition, the formation of the assembly and the supply thereof to the tape-making machine has created problems.

Mention may also be made of the fact that when the stringer is subjected to transverse stress, i.e. tension, the filler cord and the shank-connecting strands must be able to take up the total stress. Singularities in the application of stress can normally be detected at which locations considerable shear is generated. Because of the manner in which the assembly is connected to the tape, there it little distribution of the stress to the tape itself.

Because of this concentration of stress, the structure of the tape and the connection, under transverse tension, may change and with time the stringer may become unusable.

Tests have shown, for example, that individual coupling members can twist out of position about the axis parallel to the axis of the stringer relative to the tape plane. Thus one can conclude that the connection coupling member of the tape is not sufficiently torsion resistant. When the slide fastener is used in garments, for example, it may open at a disadvantageous moment and the improper lie of the coupling member may result in inability to move the slider along the rows. If the dislocation remains the overall ability of the slide fastener to withstand transverse stress is reduced.

It has been proposed to decrease the transverse-tension and torsion sensitivity of such slide fasteners by providing grooves at the foot of each coupling member and introducing additional strands into the latter. This significantly increases the fabrication problems and does not give rise to a proportional improvement in the ability of the device to resist stress in the form of transverse tension or torque.

Finally, it may be noted that it has been proposed heretofore to form, by suitable injection molding machines and dies, coupling members directly upon the support tapes and in such configuration that they embrace the edges of the tape. This technique, however, has been found to be practical only for relatively large coupling members and has not been exploited with complete success for garment fasteners which must be of fine and reliable construction.

OBJECTS OF THE INVENTION

It is the principal object of the present invention to provide an improved slide-fastener stringer whereby the disadvantages of the earlier system can be avoided.

Another object of the invention is to provide a slide-fastener stringer capable of resisting all the stresses to which the coupling members and the tape may be subject and minimizing any shifting of the coupling members relative to the tape.

Still another object of the invention is to provide an improved method of making a slide-fastener stringer relatively inexpensively and at high speeds.

SUMMARY OF THE INVENTION

These objects and others which will become apparent hereinafter are attained, in accordance with the invention, by providing each fabric tape with relatively large mesh openings in the region of the shanks through which the shanks of each coupling member can be welded, the remainder of the tape having relatively small mesh openings, i.e. openings which can be substantially smaller than those through which two shanks are thermally bonded together.

The term "mesh opening" is used herein to refer to the openings which inhere in a fabric formed by knitting and/or weaving. Thus they include spaces in knit loops and those defined between neighboring pairs of crossing weft and warp yarns.

The invention is based upon my discovery that a reliable attachment of each coupling member to the respective tape can be achieved by causing the shanks of the coupling member to straddle the tape and then bonding the mutually juxtaposed surfaces together through the relatively large openings, and then condensing all of the openings, i.e. making all openings except those through which bonding has occurred, smaller.

Such support tapes can be relatively loosely woven or knitted so that large mesh openings are initially formed throughout, although only those openings at which shanks are welded together remain large.

In this state the tape is highly yieldable (stretchable) and is unstable with respect to longitudinal and transverse tension.

However, when the tape is subjected after mounting of the coupling members, to thermofixing a shrinkage occurs which condenses the unoccupied mesh opening and provides the necessary resistance to stretching and locks the coupling members to the tape in a surprisingly effective manner sufficient for use in a slide fastener. The term "thermofixing" is used in the same manner as the term "thermosetting" previously mentioned.

This is the reason why, in accordance with the present invention, the support tapes are composed of synthetic-resin yarns or filaments which tend to shrink upon heating.

The synthetic-resin yarns or filaments of the support tapes of the present invention function in a unique manner.

Not only does the thermofixing render the U-bent coupling members stress-free and thereby increase their mechanical strength, but the shrinkage of the filaments or yarns in the regions between the shanks does not cause deformation or any other undesirable effect. Furthermore, the condensation of the mesh openings elsewhere on the tape provides a relatively dense tape with excellent stability. This is especially the case when the thermofixing is carried out under slight tension in the longitudinal direction of the slide-fastener stringer.

The deformation of the flat blanks into U-shaped coupling members and the thermofixing can be carried out continuously in a manner which is fully compatible with modern weaving and knitting machines so that there is no reduction in the speed thereof from the speeds which prevail when the tapes are made.

According to a feature of the invention, the support tapes have thickened inner edges or beads which can be formed by filler cord woven or knitted into the tapes along these edges.

In addition, the shanks of the coupling members may be connected by a textile support strand which is embedded in the shanks and which thus forms a ladder assembly with the blanks prior to bending whereby the blanks constitute rungs of the ladder assembly.

In addition and, if desired, the shanks can engage a bead lying inwardly of the edge bead. Reference in this connection may be made to the concurrently filed copending application Ser. No. 125,781.

According to another aspect of the invention, the ladder assembly is subjected to heating and the blanks adapted to form the U-shaped coupling members are pressed successively into a bed of a wheel by a sword which is of progressively decreasing width in the direction of feed of the ladder assembly and the tape between the shanks.

The shanks are then pressed together with the welding pressure and the sword and/or bed can be heated to ensure bonding in the manner described. The support tape can be held under tension during and upon welding and passed under tension through the thermofixing device which causes the shrinkage described.

The sword can serve as a guide for the tape which can also be preheated and which is fed gradually between the shanks tangentially to the wheel being inserted progressively as the free height or width of the sword decreases.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 2:
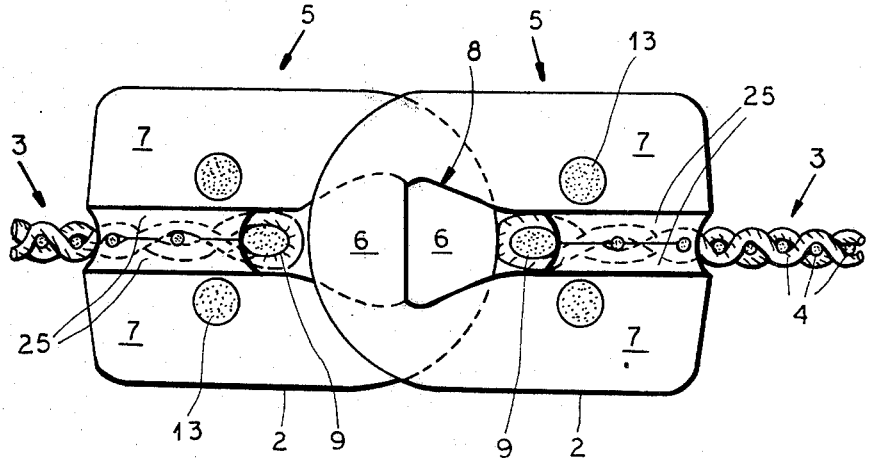
FIG. 2 is a cross-sectional view taken along the line II—II of FIG. 1.
Figure 1:
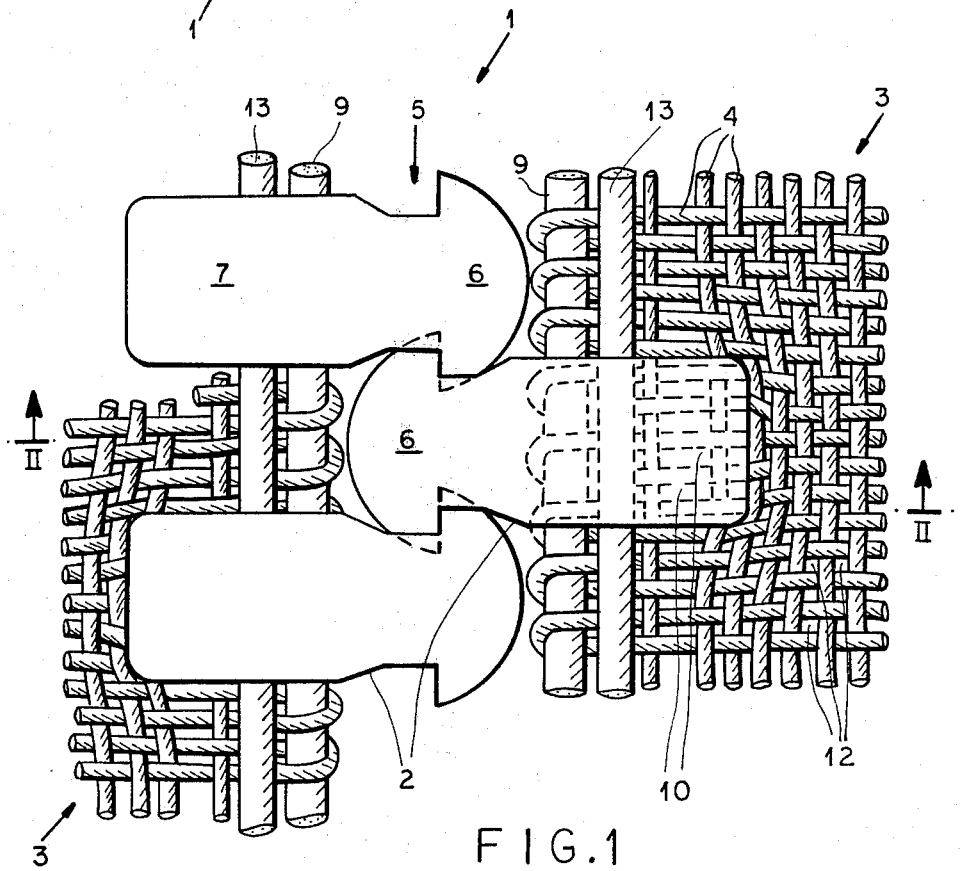
FIG. 1 is a greatly enlarged fragmentary plan view, partly in diagrammatic form, of a stringer tape in accordance with the present invention.

FIGS. 1 and 2 show a slide-fastener stringer 1 having U-shaped coupling members 2 of thermoplastic synthetic resin straddling respective edges of support tapes 3 and spaced apart in respective rows so that the coupling heads of these members can interdigitate as shown in FIG. 1.

The support tapes 3 are composed of synthetic-resin yarns or filaments 4 which are thermally shrinkable.

The stringer 1 can also include a slider and end-stop members as previously described although these members have not been illustrated and can be conventional.

The rows of coupling members are represented at 5.

The U-shaped coupling members 2, formed with the coupling heads 6 at their bights, have coupling eyes 8 between the respective shanks 7 of the U.

The shanks 7 straddle the inner edge 9 of the respective support tapes 3 and are affixed thereto. The method of attachment is best seen in FIG. 2.

In the region of the shanks 7, the tapes 3 have mesh openings 10 which are relatively large and through which the shanks 7 can be thermally welded, at the same time bonding to the threads or filaments in the region overlain by the shanks. These filaments or threads 11 can at least in part be bonded to the thermoplastic shanks during the welding operation.

The support tapes 3, after fixing of the coupling members 2 in place, are thereupon thermofixed, i.e. shrunk so that the remaining meshes 12 are condensed relative to the original mesh size 10.

In the preferred embodiment of the invention, the tapes are each formed with thickened beads along their inner edges 9 as formed by textile cords which are, in the embodiment shown, engaged by the weft filaments of the weave. Naturally, a bead can be formed by knit loops or engaged in a knitted tape correspondingly.

As has been described in the aforementioned concurrently filed copending application, moreover, the shanks 7 can also engage an inner bead.

Figure 3:
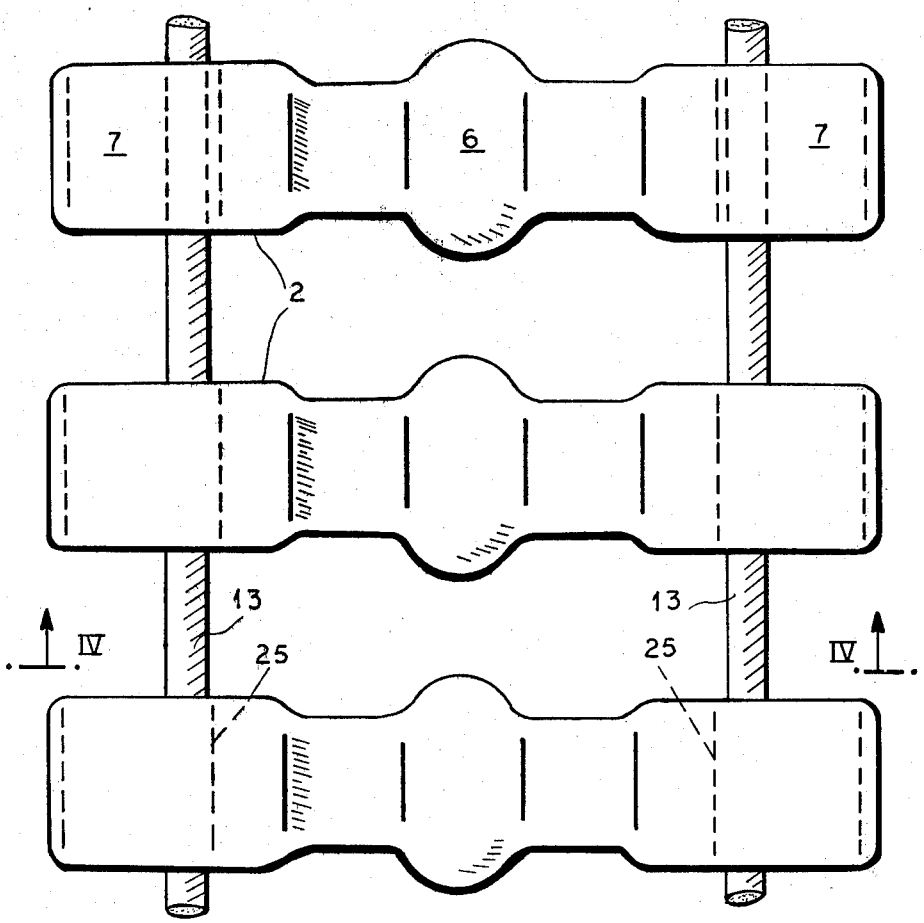
FIG. 3 is a plan view of a ladder assembly of coupling blanks prior to bending.

The shanks 7, moreover, are interconnected along the respective rows by textile connecting strands 13 which, as can be seen in FIG. 3, form a ladder structure with the coupling members before they are bent from their flat blank configuration.

Figure 4:
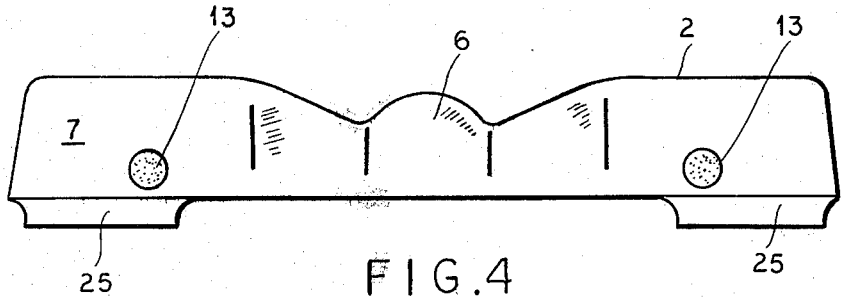
FIG. 4 is a cross-sectional view taken along the line IV—IV of FIG. 3.
Figure 5:
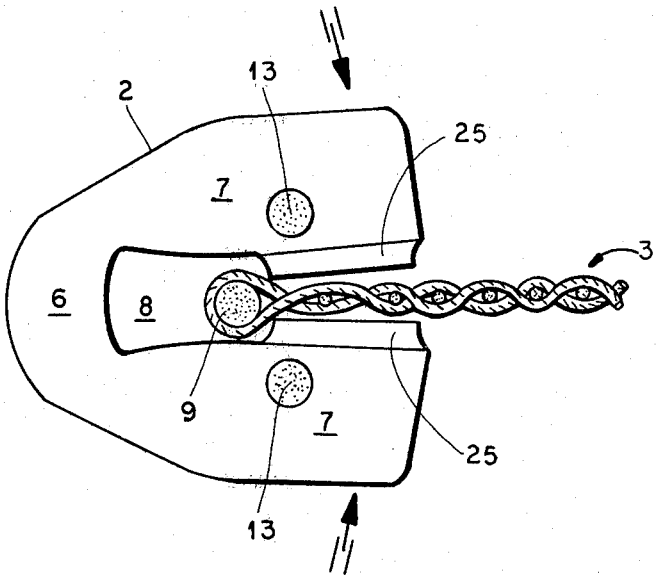
FIG. 5 is a cross section corresponding generally to FIG. 2 showing the operation whereby the coupling member is anchored to the tape.
Figure 7:
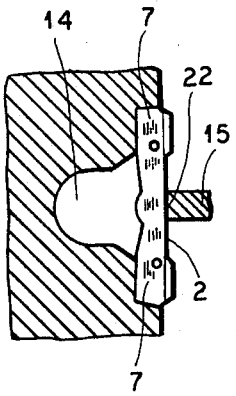
FIGS. 7, 8 and 9 are views taken along the lines VII—VII, VIII—VIII and IX—IX, respectively, of FIG. 6 showing successive operations in the mounting of the coupling members.
Figure 8:
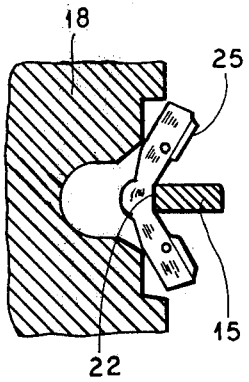
Figure 9:
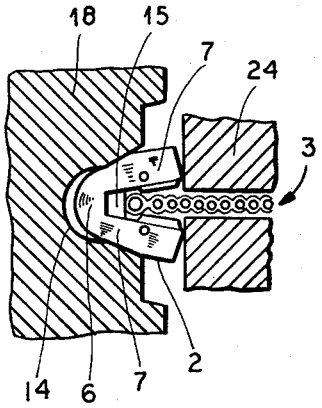
Figure 6:
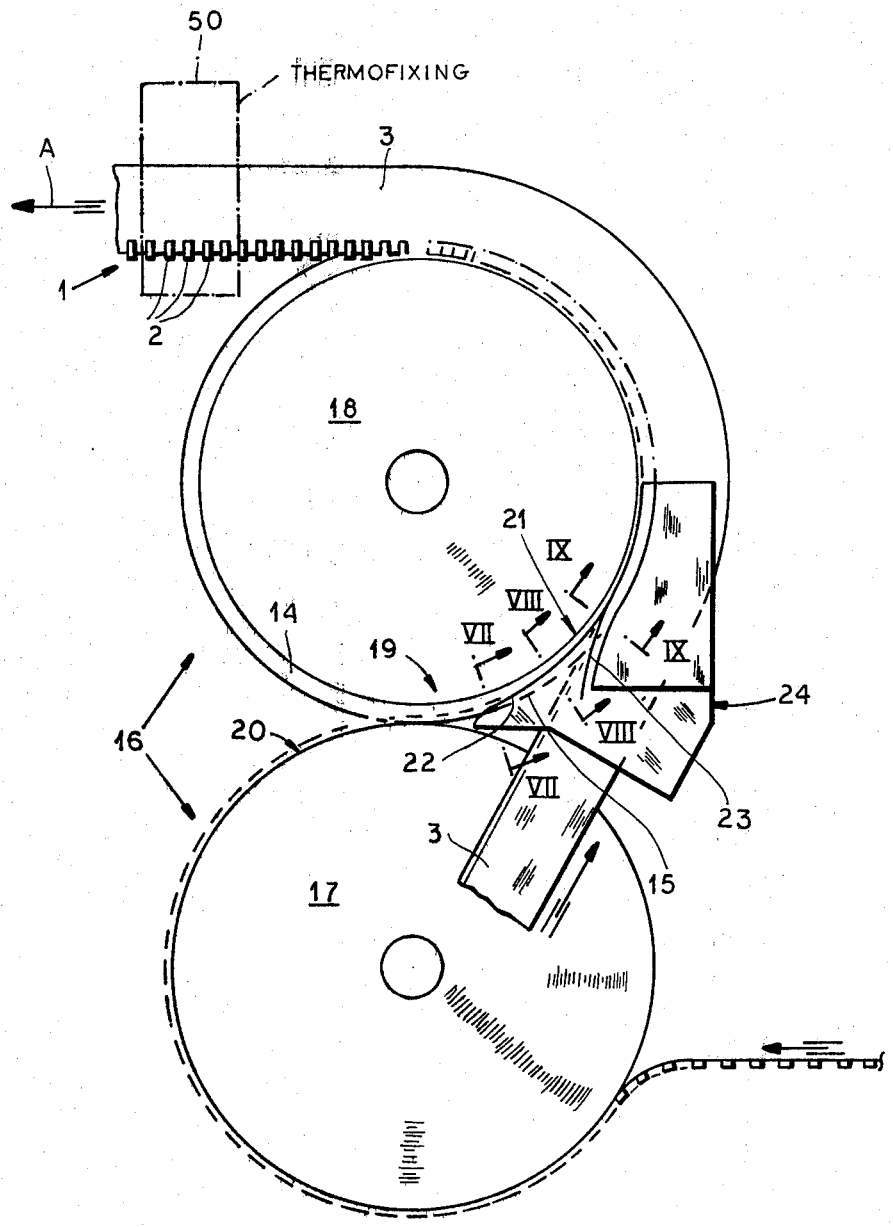
FIG. 6 is a side elevational view, also in diagrammatic form, of an apparatus for carrying out the method of the present invention.

FIGS. 3 through 5 illustrate the method of the present invention in somewhat greater detail. Initially, the ladder assembly shown in FIG. 3 is formed, e.g. by molding the blanks 6 continuously on a forming wheel connected with an injection molding or extruding machine, the continuous ladder assembly being then fed to the knitting machine or loom in which the tape 3 is formed. Adjacent the output side of this knitting machine or loom, the device shown in FIG. 6 is provided.

The individual coupling members 2 are then bent around the mandrel formed by a sword 15 and described subsequently, so that the shanks 7 are disposed inwardly of the edge bead 9 and are welded together, force being applied in the direction of the arrow shown in FIG. 5.

Both the tape and the shanks 7 of the coupling members are heated to the welding temperature and the shanks are then pressed against the tape and into contact with each other at projections 25 from these shanks. The projections are then welded to one another and are retained against the bead 9 upon the application of transverse stress. The welding is effected under light tension stress as the assembly and the tape are advanced in the direction of the arrow A shown in FIG. 6.

FIGS. 6 through 9 illustrate the apparatus for carrying out this process, this apparatus comprising a heated sword-shaped member 15 which coverges in the direction of advance of the stringer tape 3 (arrow A) positioned to cooperate with a shaping bed formed as a groove in the periphery of a wheel 18 constituting with a drum 17, the bending device. The height or width of the blade 15 decreases in this direction so that the support tape 3 can be fed along the outer edge of this member while the inner edge presses the coupling members into the bed 14 as shown at 22 in FIGS. 7 through 9. The edge 23 which converges toward edge 22, serves to guide the tape uniformly and tangentially between the shanks (see FIG. 9). The tape-feed device has been represented generally at 24.

The drum 17 which can have a smooth or slightly roughened but otherwise uncontoured periphery, defines a heating path 20 which merges at a transfer zone 19 with the transport and bending zones 21 of the device 16.

The wheel 18 is driven and drum 17 merely frictionally entrained. The heating means for the wheel 18, the blade 15 and the feed device 24 are all temperature controllable so that the welding process can be reliably guaranteed.

The thermofixing unit has been represented at 50 and serves to shrink the tape and relieve stresses in the coupling members 2 in the usual manner.

I claim:

1. A slide fastener stringer comprising a pair of slide fastener halves each provided with a fabric support tape having a longitudinal edge and consisting of synthetic resin strands forming mesh openings, and a row of U-shaped coupling members straddling said edge and interdigitable with the coupling members of the other slide fastener half, said coupling members each having a pair of shanks welded together through mesh openings of the respective tapes located between the shanks, said mesh openings between the shanks of each coupling member being larger than the mesh openings elsewhere of sai tapes.

2. The stringer defined in claim 1 wherein said tapes are thermofixed to condense the mesh openings of the tape except for those mesh openings through which shanks of respective coupling members are welded together.

3. The stringer defined in claim 2 wherein each of said tapes along the respective longitudinal edge is formed with a thickened portion engaged by the respective coupling members.

4. The stringer defined in claim 3 wherein the thickened portion along each of said longitudinal edges is formed as a bead incorporated in the fabric of the respective tape.

5. The stringer defined in claim 3 wherein the thickened portion is a bead engaged by the shanks of the respective coupling members.

6. The stringer defined in claim 3, further comprising additional textile strands embedded in and connecting corresponding shanks of the coupling members of the respective tape.

7. A method of making a slide fastener stringer half which comprises:

forming a fabric tape with synthetic resin strands defining relatively large mesh openings and having a longitudinal coupling edge;

applying a succession of U-shaped coupling members to said tape along said edge so that shanks of each coupling member straddle said tape at said edge;

thermally welding said shanks together through mesh openings between the shanks of each coupling member; and thermofixing the tape with said coupling members thereon to stress-relieve said coupling members and shrink said strands thereby condensing the mesh openings of the tape except for those through which shanks of respective coupling members are welded together.

8. The method defined in claim 7 wherein said coupling members are formed as flat coupling blanks interconnected by textile strands embedded in shanks thereof to form a ladder assembly, said method further comprising the steps of continuously heating at least the shanks of said ladder assembly and feeding said blanks continuously to a bending bed, pressing said blanks successively to bend the shanks of the blank toward each other with a sword-shaped member received between said shanks, and guiding said tape between the shanks as they are bent toward each other with said member.

9. The method defined in claim 8 wherein said tape is maintained under tension during the welding of the shanks of said coupling members together.

10. The method defined in claim 8 wherein said tape is heated prior to its insertion between said shanks, said member being heated as well.

* * * * *